United States Patent [19]

Rakestraw et al.

[11] 4,154,011

[45] May 15, 1979

[54] PERSONALIZED IDENTIFICATION BAND

[76] Inventors: Roger Rakestraw, 8315 S. Rte. 53, Woodridge, Ill. 60515; Donald L. Rakestraw, 47 Cambridge La., Lincolnshire, Ill. 60015

[21] Appl. No.: 853,388

[22] Filed: Nov. 21, 1977

[51] Int. Cl.[2] ..... G09F 3/14

[52] U.S. Cl. ..... 40/21 C; 40/2.2

[58] Field of Search ..... 40/21 C, 2.2, 21 R, 40/304

[56] References Cited

U.S. PATENT DOCUMENTS

| | | | |
|---|---|---|---|
| 1,246,753 | 11/1917 | Taylor | 40/2.2 |
| 1,890,280 | 12/1932 | Divekey | 40/304 |
| 2,163,016 | 6/1939 | Barker | 40/304 |
| 2,954,620 | 10/1960 | Richmond | 40/21 C |
| 2,961,785 | 11/1960 | Toepfer | 40/21 R |

FOREIGN PATENT DOCUMENTS

| | | | |
|---|---|---|---|
| 2502573 | 7/1975 | Fed. Rep. of Germany | 40/304 |
| 2512983 | 10/1975 | Fed. Rep. of Germany | 40/2.2 |

*Primary Examiner*—Louis G. Mancene
*Assistant Examiner*—Wenceslao J. Contreras
*Attorney, Agent, or Firm*—Hill, Gross, Simpson, Van Santen, Steadman, Chiara & Simpson

[57] ABSTRACT

A fireproof personalized identification band or bracelet to be worn by airplane passengers or others exposed to the possibility of a flame-related disaster, which will enable accurate identification of bodies burned beyond recognition. Further, the identification band may also provide immediate identification of an individual in case of injury or illness.

7 Claims, 7 Drawing Figures

PERSONALIZED IDENTIFICATION BAND

BACKGROUND OF THE INVENTION

Personalized identification bracelets have long been utilized to provide useful information and warnings relative to the wearer thereof, as for example "medical alert" bracelets; hospital identification bands and the like. While these devices serve an important function they are not applicable in the immediate amd positive identification of badly burned bodies in the very rare instances of conflagrant disasters, such as an airliner crash or a refinery explosion. While metal engraved identification bracelets would generally withstand the flames and heat of a fiery catastraphe, the cost and difficulty of producing them in a short period of time would all but nullify their use in connection with commercial air travel or most chemical plant applications.

Over the last several years many hundreds of people have been buried in mass or unmarked graves because no identification on their person was able to withstand the flames and disintegration of a fiery disaster. In these situations, officials are confronted with the grisly task of utilizing dental records or other obscure physical evidence in attempting to recognize individual bodies and then with only minimal success. Thus, frequently, coupled with the loss of a loved one the family of a victim is denied the custom of burying him with dignity. Further, without proper identification of a victim insurance claims are difficult to institute.

SUMMARY OF THE INVENTION

The present invention is directed to an inexpensive, easily and quickly produced identification wrist band which will resist intense heat associated with conflagrant disasters and which is comfortable to wear. The wrist band comprises an asbestos filled, flexible plastic or silicone-type sheet material having suitable density and forming properties to accept and retain impressions therein. Alternately, other flexible materials can be utilized which will retain indicia embossed therein or stenciled thereon when subjected to flames and elevated temperatures up to 480° C. (900° F.), (or higher).

The wrist bands are provided with positive fastening means in order to secure them around the wrist of an airline passenger or others exposed to the possibility of a flame-related disaster.

Each passenger would be issued a personalized identification wrist band when boarding an airliner which could also serve as a boarding pass or to reserve a specific seat in the plane. In addition to the name of the passenger the band may include a flight number and the airline company, as well as other desirable information such as seat number or destination.

In the event of a conflagrant disaster each passenger could be immediately identified. Relatives would be able to secure accurate identification of their loved ones in a quicker and more efficient manner, as well as being able to quickly recognize the identity of the injured when in a comatose state. Airline officials would be saved possible embarrassment and publicity by not being able to identify crash victims.

Among the objects of this invention is the provision of a simple, inexpensive yet effective fireproof identification band to be worn by individuals exposed to the possibility of a flame-related disaster which will enable accurate identification of bodies burned beyond recognition.

Another object of the invention is to provide a personalized fireproof identification band which is quick and easy to produce.

Further objects and advantages of the invention will become apparent from the following description taken in conjunction with the accompanying drawings, although variations and modifications may be effected without departing from the spirit and scope of the novel concepts of the disclosure.

DETAILED DESCRIPTION OF THE INVENTION

Figure 1:
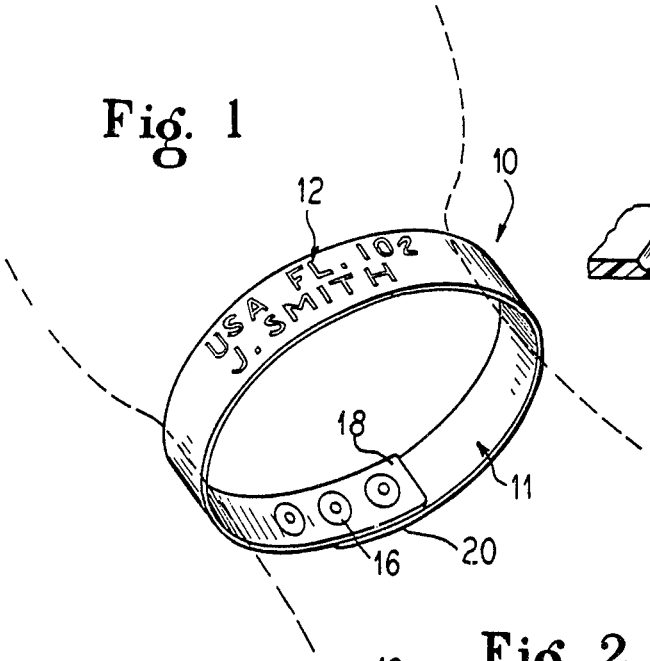
FIG. 1 is a perspective view of a personalized, fireproof identification band adapted for wear around an individual's wrist and including the principles of the present invention.

In FIG. 1 of the drawings we show a personalized identification bracelet 10 comprising an elongated band 11 formed of a flexible, fireproof polymer such as an asbestos filled resin or a silicone resin, or other appropriate high temperature materials which will be confortable to wear and will retain identifying lettering or indicia 12 on a top surface 13 thereof, even though the bracelet 10 may be exposed to impinging flames and elevated temperatures of 480° C. (900° F.) or higher. The bracelet 10 may be in the order of 1mm thick, 12 to 15mm wide and being approximately 25 cm long for an adult size. The identifying lettering 12, preferably will include the name of the individual wearing the bracelet with such other necessary information as may be desirable in the mode of use.

In connection with air travel the flight number and the air carrier may also be displayed. Herein, a passenger, upon boarding an airliner would be issued the bracelet 10 along with his ticket or boarding pass. Alternately, the bracelet could serve as the boarding pass in addition to providing instantaneously identification of individual passengers in instances of illness or disaster.

Figure 2:
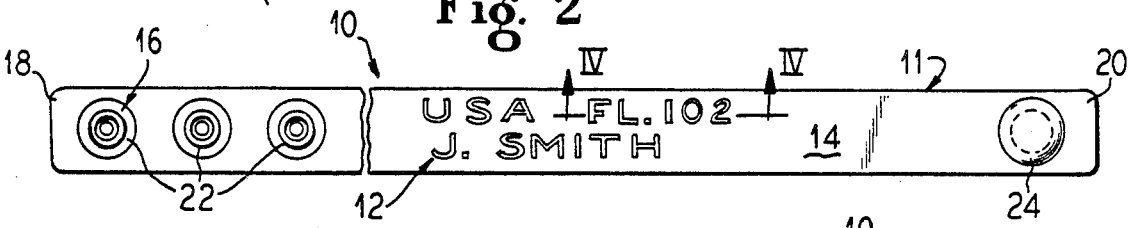
FIG. 2 is a plan view of the identification band of FIG. 1 shown in a flat laterally extending position to facilitate the application of personalized indicia thereon.
Figure 3:
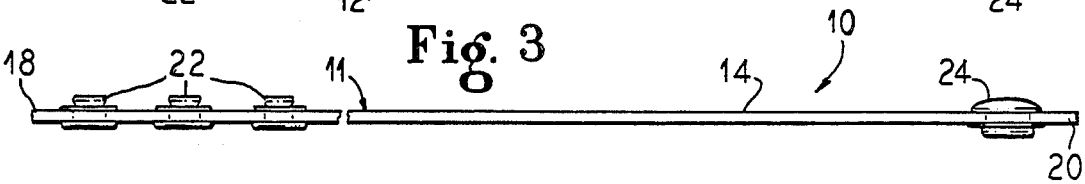
FIG. 3 is a side elevational view of the identification band shown in FIG. 2.

Fastener means 16 are provided to secure band ends 18 and 20 together, forming a closed loop for wear around the wrist of a passenger (see FIG. 1). The fastener means 16, as best seen in FIGS. 2 and 3, comprise male and female snap fastener members 22, 24, riveted or otherwise secured to the band ends 18 and 20. Preferably, a series of spaced male snap fastener members 22 are utilized at one of the band ends to permit adjustment in the size of the wrist loop which allows the use of one band length to fit most passenger wrists.

Figure 4:
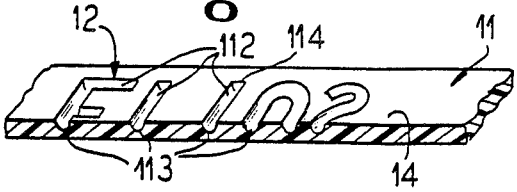
FIG. 4 is an enlarged fragmentary sectional view taken generally along the line IV—IV of FIG. 2.

The personalized information may be applied to the band 11 in any suitable manner which will retain legibility when subjected to flame and heat; however, in the preferred form of the invention the letters of the indicia 12 are impressed into the surface 14 of the band 11 as shown in FIG. 4. Herein, the letters must be impressed sufficiently deep into the band to allow for some minor degree of surface layer decomposition under the influence of prolonged heat. Thus, each letter is shown as constituting a trough-shaped recess 112 having a bight portion 113 of the necessary depth and a discrete width 114 at the surface 14. A suitable imprinting device (not shown) may be provided at airline reservation counters or other location in accordance with the identification band use to rapidly and conveniently produce them as needed. In some applications a stenciled indicia 12 may be utilized to provide a permanent inscription on the band 11 with the utilization of heat-stable pigments in the ink.

Figure 5:
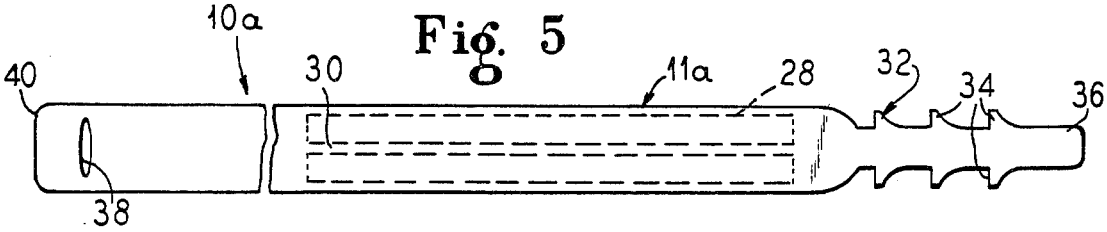
FIG. 5 is a view similar to FIG. 2 but showing an alternate embodiment of the invention.
Figure 6:
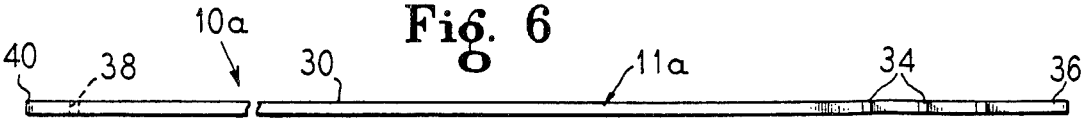
FIG. 6 is a side elevational view of the identification band shown in FIG. 5.
Figure 7:
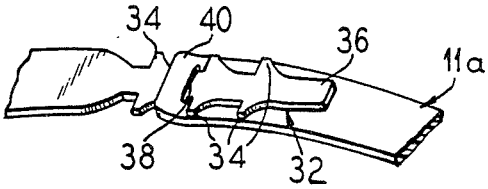
FIG. 7 is a fragmentary perspective view showing the fastening device used with the FIG. 5 embodiment.

Now with specific reference to FIGS. 5 and 6 of the drawings an alternate form of an identification bracelet 10*a* is shown comprising a pliable, elongated band 11*a* which may be formed of the same types of plastic materials as usable in the FIG. 1–3 embodiment. The bracelet 10a includes an imprint area 28 on a top surface 30 of the band 11a to receive appropriate indicia which may be applied by suitable means as previously described for use in the FIG. 1–3 embodiment. An end fastener means 32 is provided to secure the identification bracelet 10a around the wrist of an individual and includes a series of spaced retaining ears 34, arranged in complementary pairs along opposite sides of a reduced dimension end portion 36 of the band 11*a* . The end portion 36 is adapted to freely pass through an elongated slot 38 formed in a second end portion 40 of the band 11*a*, remote from the reduced dimension end portion 36. However, each of the retaining ears 34 extend laterally beyond the limits of the slot 38. Accordingly, as the end portion 36 is inserted through the slot 38 to form a wrist-encircling loop the retaining ears 34 must be bent or deformed in order to be admitted through the slot 38. However, once through the slot 38 the ears 34 return to their original non-deformed position (see FIG. 7) to secure the end portion 36 in the slot 38. Thus it may be seen from the drawings that the size of the loop formed by band 11*a* may be simply adjusted by the number of paired retaining ears 34 forced through the slot 38. Obviously a series of spaced slots 38 and a single pair of retaining ears 34 would also be effective in providing for size adjustment of the identification bracelet 10*a*. With this embodiment no additional elements are required to provide a secure and positive means of fastening the band ends together.

Although the teachings of our invention have been disclosed with reference to specific embodiments, it is to be understood that these are by way of illustration and that variations and modifications may be effected without departing from the spirit and scope of the novel concepts of our invention.

We claim as our invention:

1. An identification bracelet comprising:

an elongated band of pliable heat-resistant and flameproof material being formed of flexible plastic sheet material with suitable density and pressure sensitive forming properties to accept and retain selected impressions therein, said band having a pair of opposite end portions;

a heat-resistant fastener means associated with said end portions enabling the elongated band to be secured around an individual's wrist;

a personalized indicia adapted to be quickly impressed under pressure into a top surface of said elongated band and to retain legibility when subjected to impinging flames and elevated temperatures of at least 480° C. to provide means for identification of victims in conflagrant disasters.

2. The identification bracelet constructed in accordance with claim 1, wherein the heat-resistant fastener means comprise metal snap fasteners having a plurality of fastener members fixedly spaced along one of said end portions wherein said elongated band may be adjustably secured around an individual's wrist by selectively connecting certain of said snap fasteners at opposite ends of said elongated band.

3. The identification bracelet constructed in accordance with claim 1, wherein the heat-resistant fastener means comprise interlocking members formed in said opposite end portions of said elongated band and including tab and slot means with a plurality of said interlocking members formed in spaced relationship along one of said end portions wherein said elongated band may be adjustably secured around an individual's wrist by selectively connecting certain of said interlocking members at opposite ends of said elongated band.

4. The identification bracelet constructed in accordance with claim 1, wherein said elongated band comprises an asbestos filled plastic material having suitable density and forming properties to accept and retain said personalized indicia impressed therein.

5. The identification bracelet constructed in accordance with claim 1, wherein said elongated band comprises a silicone polymer having suitable density and forming properties to accept and retain said personalized indicia impressed therein.

6. The identification bracelet constructed in accordance with claim 1, wherein said elongated band is in the order of 1 mm thick and 12 to 15 mm wide, and wherein the personalized indicia comprises letters of trough shaped recesses having a bight portion impressed under pressure sufficiently deep into said elongated band to allow for minor surface layer decomposition when the band is subjected to prolonged heat.

7. The identification bracelet constructed in accordance with claim 1, wherein said personalized indicia includes suitable identifying flight information for use in air travel.

* * * * *